United States Patent [19]

Gandy et al.

[11] Patent Number: 5,054,168

[45] Date of Patent: Oct. 8, 1991

[54] CLIP PROVIDING IMPROVED STORAGE AND HANDLING OF FLEXIBLE BAGS

[76] Inventors: Kenneth A. Gandy, 11706 E. 75th St., Indianapolis, Ind. 46236; Paul J. Maginot, 6179 Crittenden Ave., Indianapolis, Ind. 46220

[21] Appl. No.: 533,484

[22] Filed: Jun. 5, 1990

[51] Int. Cl.[5] ..... B65D 77/10

[52] U.S. Cl. ..... 24/30.5 R; 24/517; 24/30.5 L

[58] Field of Search ..... 24/30.5 R, 30.5 L, 30.5 S, 24/30.5 T, 517; 294/1.3

[56] References Cited

U.S. PATENT DOCUMENTS

| | | | |
|---|---|---|---|
| 1,459,735 | 6/1923 | Kraft | 24/30.5 R |
| 3,266,711 | 8/1966 | Song | 24/30.5 R |
| 4,296,529 | 10/1981 | Brown | 24/30.5 S |
| 4,648,160 | 3/1987 | Spinosa et al. | 24/30.5 R |
| 4,671,427 | 6/1987 | Farquharson | 24/30.5 R |
| 4,803,759 | 2/1989 | Kemble | 24/30.5 R |

*Primary Examiner*—Victor N. Sakran

[57] ABSTRACT

A preferred bag cutting and closing clip is described. The clip includes two elongate members and means for directing the elongate members toward one another to close the bag. The clip also includes cutting means such as serrations effectively positioned on the clip for severing bag portions on one side of the clip from bag portions on another side of the clip while the bag remains effectively closed between the elongate members. A preferred clip also includes the feature of extendability, as well as other highly advantageous design features. A method of closing an open flexible plastic or paper bag and for removing excess bag portions therefrom is also described.

20 Claims, 6 Drawing Sheets

CLIP PROVIDING IMPROVED STORAGE AND HANDLING OF FLEXIBLE BAGS

BACKGROUND OF THE INVENTION

The present invention relates generally to closure devices for flexible bags such as plastic or paper bags used to package potato chips and the like. More particularly, this invention relates to a novel clip which provides improved storage and handling of such flexible bags.

By way of further background, for quite a while now snack foods such as chips, pretzels, etc. have been packaged and sold in plastic or paper bags. Many times, these bags are sufficiently large to contain more product than necessary for a single serving or simultaneous set of servings. Consequently, it has been necessary to reclose the bags once opened, and to store the partially-emptied bag until further use. Quite naturally, therefore, there has been a great interest in providing means by which the bags can be reclosed until later use.

The most common of these prior means known to applicants is a butterfly-type clip having two members which are pivotally connected and biased, as by a spring, toward one another. The commercial butterfly clips known to applicants have clipping members which are relatively short in comparison to the width of bags containing potato chips or other snacks. In use, the flexible bag to be closed is folded over at least once, and the butterfly clip is used to hold the fold in place to keep the bag closed. Often, for storage convenience, the bag is folded over several times to reduce its effective size prior to application of the clip.

Another type of clip is illustrated in U.S. Pat. No. 4,296,529 to Brown. The Brown patent shows a bag clip in which two elongate members are pivotally or hingedly connected at one end, and can be used to span the girth of the bag and can be clamped together to close the bag. Like the butterfly clip, in using this type of clip the bag could be folded over to reduce its overall size for storage, but this nevertheless leaves the stored bag more bulky than it need be. Additionally, this situation causes inconveniences in handling and reopening the bag, and in having to reach far down into the bag to retrieve more chips when eating directly out of the bag, as is often done. Reaching far down into the bag can be a particularly troublesome problem because the insides of snack bags are often somewhat oily from the product they contain. This can dirty the arm of the consumer or perhaps more damagingly dirty a shirt sleeve covering the arm. This type of problem is equally encountered in the butterfly-type clips discussed above.

What is therefore needed is a device and method for eliminating these storage and handling problems. Such a device should preferably be inexpensive to manufacture, and simple to use, and yet provide these desirable features. The applicants' invention addresses these needs.

SUMMARY OF THE INVENTION

In addressing these needs, the invention provides in one preferred embodiment a bag cutting and closing clip which comprises two elongate members, and means for directing the elongate members toward one another to close the bag. The clip also has cutting means, such as serrations, which are provided and effectively positioned for severing bag portions on one side of the clip from bag portions on another side of the clip while the bag remains effectively closed between the elongate members. In this manner, the clip can be applied to the bag at some location along the bag's length above the level of the remaining product, but below portions of the bag toward its open end which are in excess of that needed. The bag portions toward the open end can then be gripped and torn across the serrations, thus separating the excess bag portions from the necessary bag portions still containing product. The size of the bag for storage has thus been effectively reduced in a simple and convenient operation, and upon re-opening a consumer need not reach far into the remaining bag to get to product.

Another preferred embodiment of this invention relates to a method for closing an open flexible bag and removing excess bag portions therefrom. This method comprises the steps of (i) closing the bag between two elongate members provided on a clip also having cutting means effectively positioned for severing an excess bag portion on one side of the clip from a necessary bag portion on another side of the clip, and (ii) grasping and pulling the excess bag portion along the cutting means whereby it is severed from the necessary bag portion.

One object of this invention is to provide clips and methods which provide for the improved convenient storage and handling of flexible bags.

Another object of this invention is to provide clips for closing flexible bags and also having means to cut excess bag portions from necessary bag portions still containing product.

Still another object of this invention is to provide a method for closing flexible bags and removing excess bag portions therefrom.

Additional objects and advantages will become apparent upon reviewing the description which follows.

DESCRIPTION OF THE PREFERRED EMBODIMENTS

Figure 1:
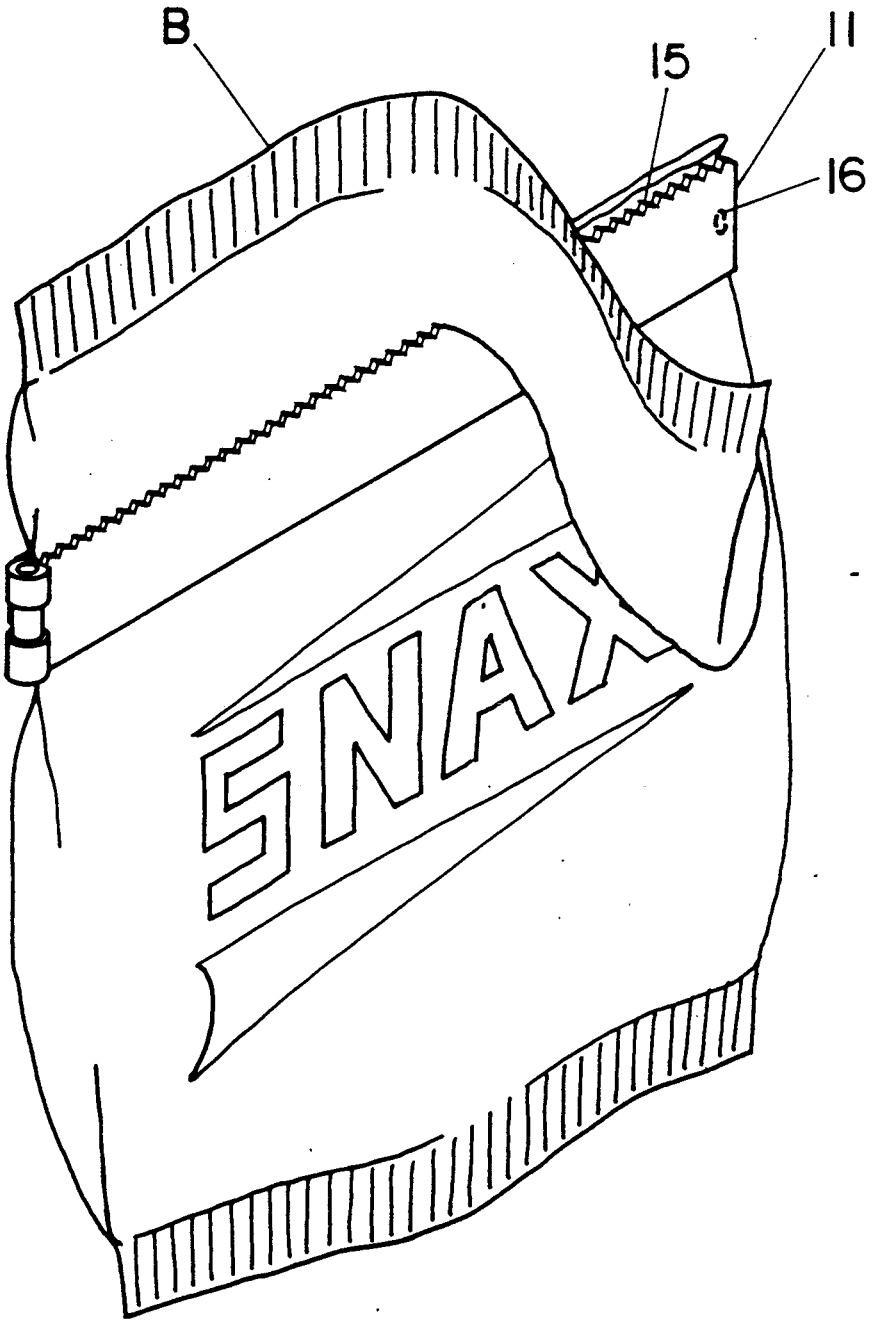
FIG. 1 is a perspective view of a bag closing and cutting clip according to the invention in its use environment.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

As stated above, one preferred embodiment of this invention is a bag cutting and closing clip which comprises two elongate members and means for directing the elongate members toward one another to close the bag. Cutting means, such as serrations, are also provided on the clip and are effectively positioned for severing bag portions on one side of the clip from bag portions on another side of the clip while the bag remains effectively closed between the elongate members.

Referring now to FIG. 1, shown is such a bag cutting and closing clip 11 in its use environment. The clip 11 has been applied to a bag "B" and excess portions of the bag, have been partially severed across serrations 15 which provide cutting means on the clip 11. As can thus be seen, the clip 11 provides for improved storage and handling of partially full paper, plastic or like flexible bags of potato chips or other snacks.

Figure 2:
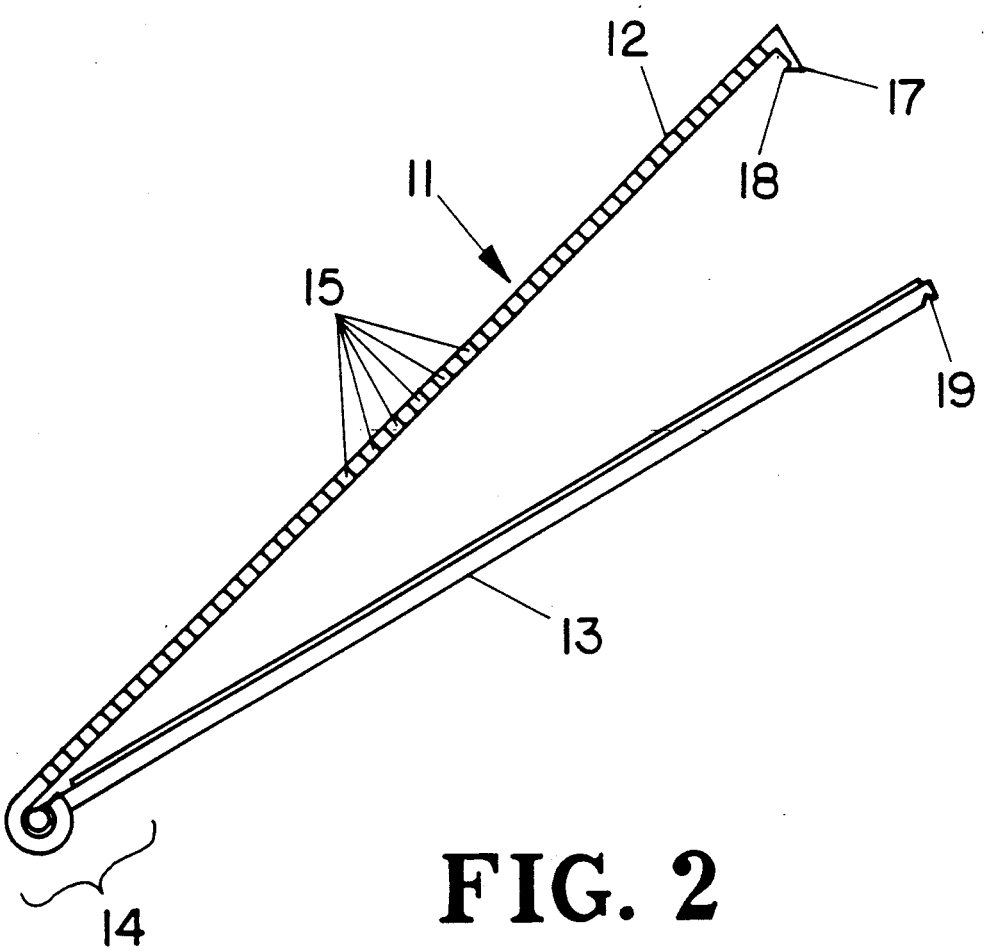
FIG. 2 is a top view of a bag closing and cutting clip according to the invention.
Figure 3:
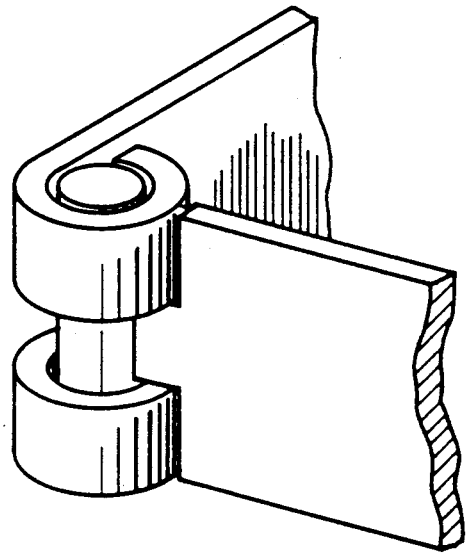
FIG. 3 is a perspective view of an illustrative pivot means incorporated into a preferred bag cutting and closing clip of the invention.

Referring now particularly to FIG. 2, the clip 11 has two elongate members 12 and 13 which are preferably made of rigid or at least substantially rigid plastic. The clip 11 also has means for directing the elongate members 12 and 13 toward one another to substantially span and close the bag. In the illustrated device, these means comprise a pivotal or hinged connection of ends of the elongate members 12 and 13, generally designated as 14 (shown in more detail in FIG. 3). Of course, any other known means of directing the elongate members 12 and 13 toward one another in an overlapping fashion which allows for closure of the bag would suffice and is contemplated as being within the scope of the invention. It is preferred that the elongate members be at least about 10 inches in length, more preferably at least about 14 inches, and can be even longer, such as 16 inches or more, where commercial bag sizes would require it.

The clip 11 also has cutting means such as serrations 15 provided and effectively positioned for severing an excess bag portion on one side of the clip 11 from a necessary bag portion on another side of the clip 11. In the preferred clip 11, the serrations 15 are also positioned such that the bag closed by the clip 11 remains effectively closed during and after the severing function. As will be understood, cutting means other than serrations 15, such as a sharp edge or the like, could be used. Serrations 15, however, are preferred in most applications over sharp edges for the obvious safety reasons. Additionally, although the serrations 15 in the preferred clip 11 are integrally formed in an edge of the elongate member 12, the serrations 15 could also be provided on the clip 11 separately from the member 12 so long as still positioned to have the severing efficacies as mentioned above. Further, serrations could also be provided along an edge of each of the elongate members 12 and 13, so that the excess bag portions could be torn along either. Further, both the top and bottom edges of the member 12 and/or both the top and bottom edges of each member 12 and 13 could have serrations 15 so that the clip 11 could be effectively applied to the bag in the usual fashion without concern over which side of the clip should face which direction with respect to the bag in order to properly position the serrations 15. The clip 11 also has means for holding the elongate members 12 and 13 together, such as cooperating snap fit means provided on the elongate members. In FIG. 1, cooperating snap fit means include an aperture in one of the members and a cooperating pin having a spherical or other protrusion which can be forced through the aperture to hold the elongate members together (shown generally at 16 in FIG. 1). In FIG. 2, the cooperating snap fit means include a claw-like arrangement shown generally at 17 which cooperates with the end of elongate member 13 such that it can be forced thereacross and snap into place with the point 18 finally residing in the recess 19. In the case of each of the illustrated snap fit means, they can be unsnapped by forcing the elongate members away from each other.

Figure 6:
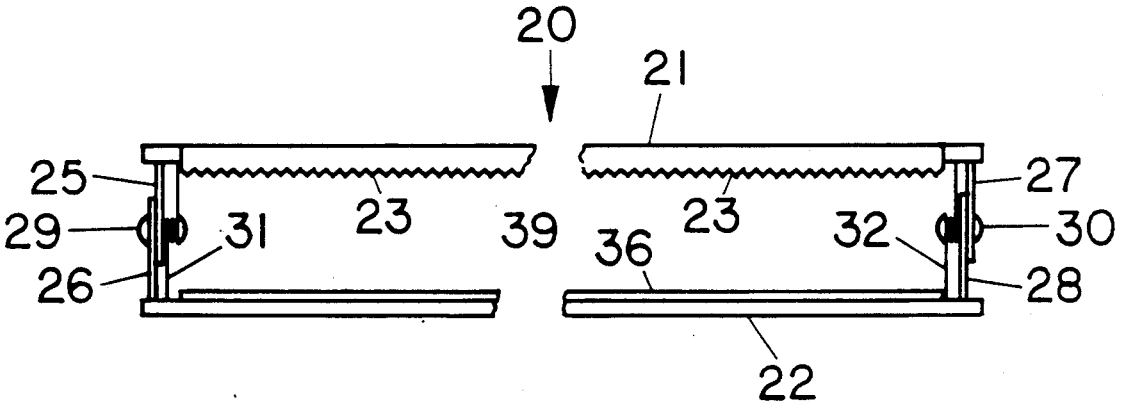
FIG. 6 is a top view of the clip illustrated in FIG. 5.
Figure 5:
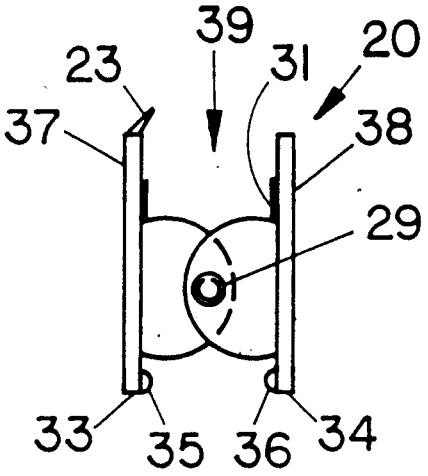
FIG. 5 is a side elevation view of the clip of FIG. 4 in its open position.
Figure 4:
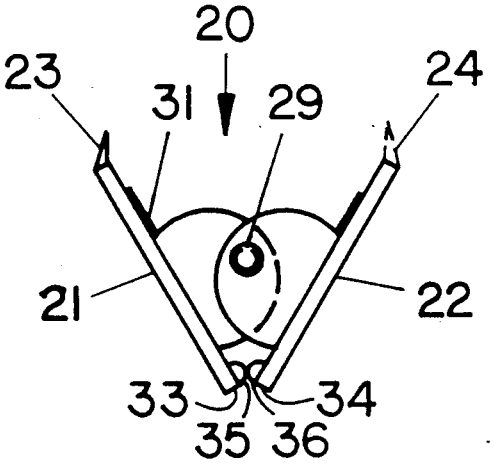
FIG. 4 is a side elevation view of another clip according to the invention in its relaxed, closed position.
Figure 7:
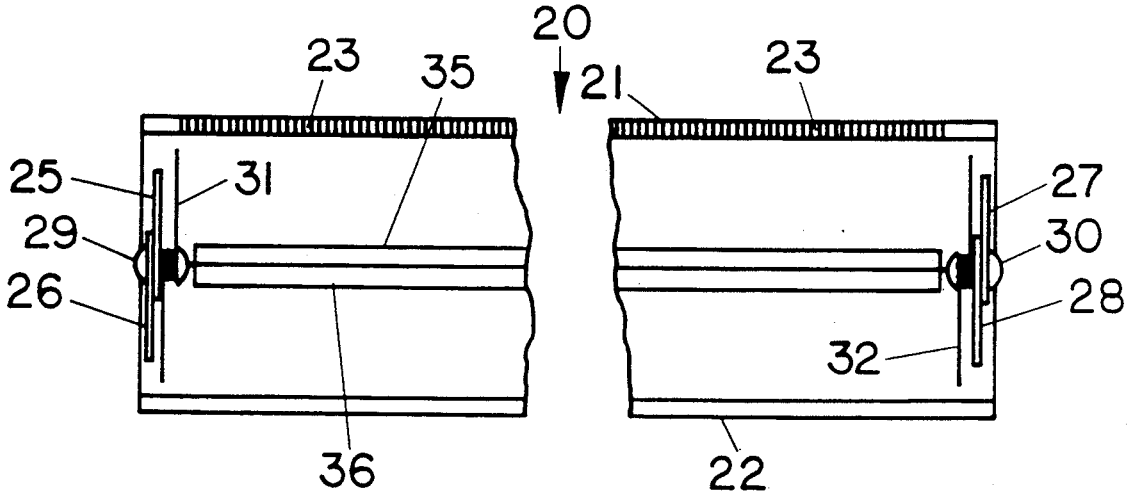
FIG. 7 is a top view of the clip illustrated in FIG. 4.
Figure 8:
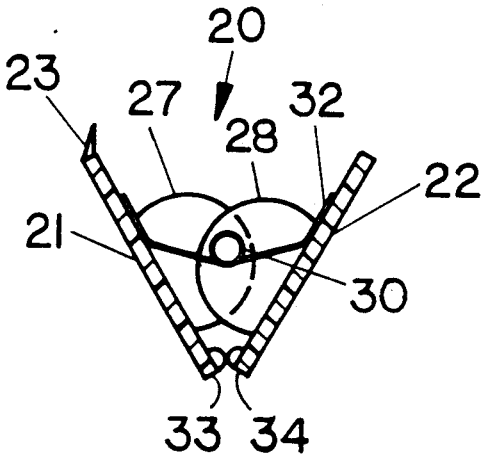
FIG. 8 is a cross-sectional view of the clip illustrated in FIG. 7 taken along line 8—8 and viewed in the direction of the arrows.

Referring now to FIGS. 4–8, shown is another clip 20 according to the invention. FIG. 4 is a side view of the clip 20 in its relaxed, closed position. FIG. 7 is a top view of the clip 20 in its relaxed, closed position. FIG. 5 is a side view of the clip 20 in an open position, and FIG. 6 is a top view of the clip 20 similarly in an open position. FIG. 8 is a cross-sectional view of the clip 20 of FIG. 7 taken along line 8—8 and viewed in the direction of the arrows.

Referring now to these FIGS. 4–8 in more detail, the clip 20 includes elongate members 21 and 22. The clip also includes serrations 23 or another suitable cutting means provided on the elongate member 21, and optionally also includes serrations 24 (dotted lines in FIG. 4) provided on the elongate member 22. The serrations 23 and 24 preferably project inwardly from the elongate members 21 and 22 to provide a more effective cutting surface for the bag. The members 21 and 22 are pivotally connected toward their outer edges so that they pivot about a longitudinal axis (i.e. an axis running in the direction of their lengths). In the illustrated device, the pivotal connection is provided by cooperating pairs of semi-circular plates 25 and 26 and 27 and 28 attached to the inner surfaces of the elongate members 21 and 22, with each pair having a rivet (29 and 30) or similar pin with retaining means on each end or other device extending therethrough, preferably toward their innermost extremities to provide adequate separation between the members 21 and 22.. The clip 20 also includes spring means provided toward at least one of its outer ends, and preferably at both, as at 31 and 32, to bias the lower edges 33 and 34 (FIG. 4) toward one another to close a bag. Additionally, compressible elongate sealing members 35 and 36 can optionally be provided to effect closure of the bag. In the illustrated device, the spring means 31 and 32 are mounted on the rivets, 29 and 30, which are suitably long to accommodate the springs while maintaining a close cooperating relationship between the plate pairs 25 and 26 and 27 and 28. Alternatively, the rivets can be only long enough to hold the plate pairs cooperatively together, and springs may be positioned just to the inside of the plate pairs and held in place by tether, bonding, contour of the inner surfaces of the elongate members (e.g. retaining walls built into these surfaces), or other suitable means.

With reference now to FIGS. 4 and 7 together, these Figures show the clip 20 in relaxed, closed position with the spring means 31 and 32 forcing the lower edges 33 and 34 and thus the sealing members 35 and 36 together. This is the position of the clip 20 when it is sealing a bag. Referring to FIGS. 5 and 6 together, shown is the clip 20 in a position as when inward force is applied (as by pinching) to the upper portions 37 and 38 (FIG. 5) of the elongate members 21 and 22. In this manner, when the bias of the spring means 31 and 32 is overcome, the edges 33 and 34 rotate and are spaced apart from each other, and there is provided a clear elongate opening 39 through the middle portion of the clip 20 through which the bag can be passed. Thus the clip 20 can be slipped over and down the bag to the appropriate position. It will be understood that to optimize this effect, the pivot means connecting the elongate members 21 and 22 should space them sufficiently far apart to allow substantial ease of passage of the bag through the elongate opening 39. In this regard, it is preferred that the width of the passage 39 be at least about one inch, more preferably at least about two inches to accomplish this result. Once properly positioned over the bag, the clip 20 can be allowed to return to its relaxed, closed position, and thereafter the clip and bag can be grasped and the bag can be torn across the serrations 23 or 24 to remove excess portions therefrom. The bag (now of reduced size) with the clip 20 sealing it can then be conveniently stored, and thereafter retrieved and reopened by forcing the clip 20 into its open position and sliding the clip 20 up off of the bag. After more snack (e.g. chips, etc.) is consumed from the bag, the bag sealing and removal of excess portions can then be repeated until the snack is depleted and the remaining bag portion is, of course, thrown away or otherwise recycled.

Figure 11:
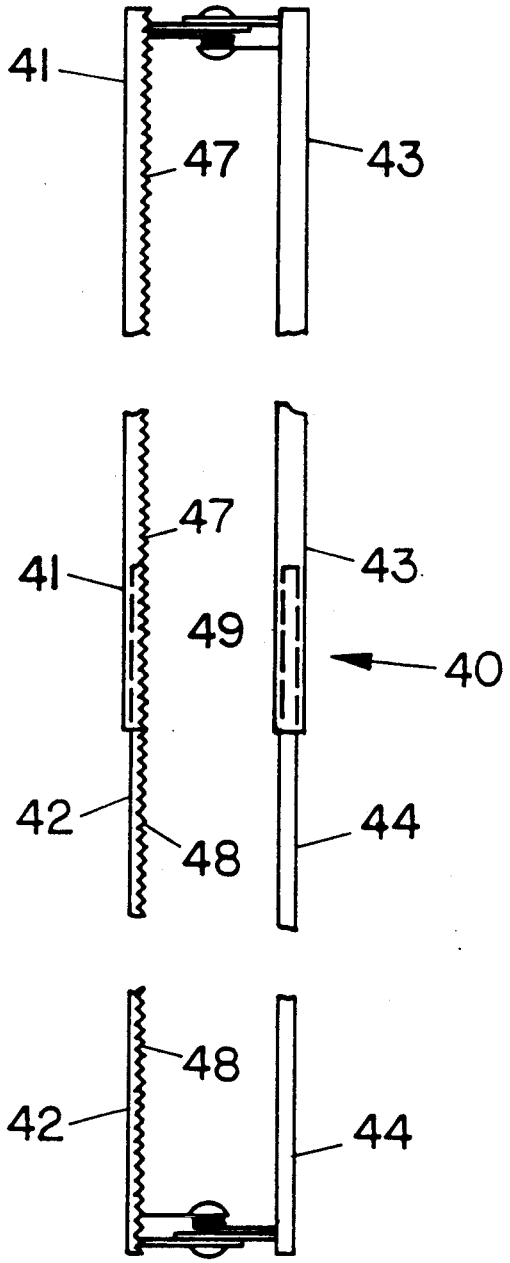
FIG. 11 is a top view of the clip as illustrated in FIGS. 9 and 10, only in its open position.
Figure 10:
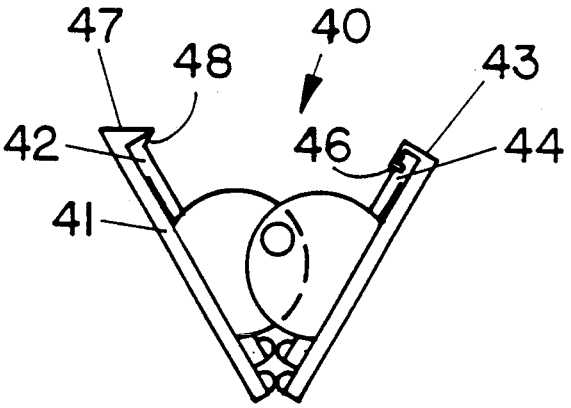
FIG. 10 is a side elevational view of the opposite end of the clip as illustrated in FIG. 9.
Figure 9:
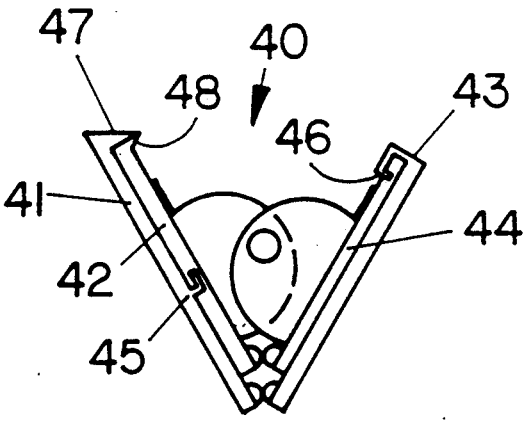
FIG. 9 is a side elevational view of an extendable clip according to the invention, in its relaxed, closed position.

Referring now to FIGS. 9–11, shown is another preferred clip 40 according to the invention. The clip 40 is similar in design to the clip 20 of FIGS. 4–8, but has the further important attribute of extendability. FIG. 9 is a left end view of the clip 40 in its relaxed, closed position. FIG. 10 is a right end view of the clip 40 in its relaxed, closed position. FIG. 11 is a top view of the clip 40 in its open position. As illustrated, the clip includes two cooperating pairs of elongate members, 41 and 42, and 43 and 44. The inner elongate members (42 and 44) are retained in slidable relation with the outer elongate members (41 and 43) and this relation is maintained by cooperating tounge-in-groove or other similar type arrangements, as at 45 and 46. Each of the elongate members 41 and 42 has serrations 47 and 48, respectively, provided thereon, and sized, shaped and positioned so that their sharp ends extend inwardly to approximately the same point to provide effective cutting while the clip 40 is extended. The inner elongate members 42 and 44 are pivotally connected similar to that in the clip 20, as are the outer members 41 and 43. Additionally, spring means are provided at each end of the clip 40 as in the clip 20. Further, cooperating sealing means are provided on lower portion of the members 41 and 43 and 42 and 44. In operation, the clip 40 can be extended to an appropriate length to accommodate the bag to be closed by sliding the inner members 42 and 44 in relation to the outer members 41 and 43 (as generally illustrated in FIG. 11). The clip 40 is then forced (e.g. pinched) to its open position (FIG. 11) and the bag to be sealed slipped through the elongate opening thus formed (again, preferably at least one inch wide, more preferably at least two inches wide). The clip 40 is then positioned appropriately on the bag above the remaining level of the product, and allowed to return to its relaxed, closed position (FIGS. 9 and 10). The excess portions of bag above the clip 40 are then torn across the serrations 47 and 48 and discarded or otherwise recycled. The remaining product can then be stored, retrieved, etc. and the entire operation repeated as before until the product is depleted. Then, the clip 40 can be collapsed back to its smallest length and stored until further needed.

Figure 13:
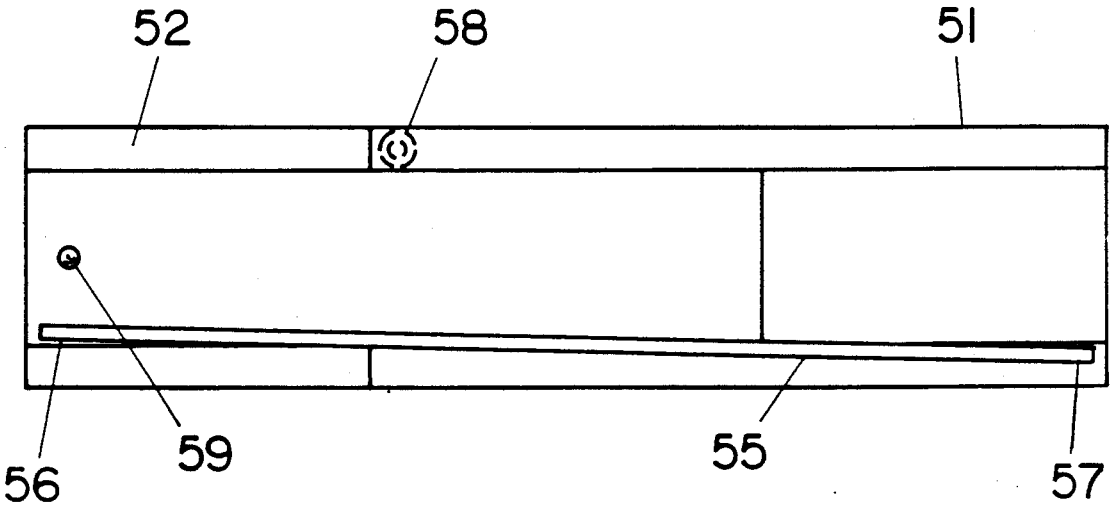
FIG. 13 is a front elevational view of the clip of FIG. 12.
Figure 12:
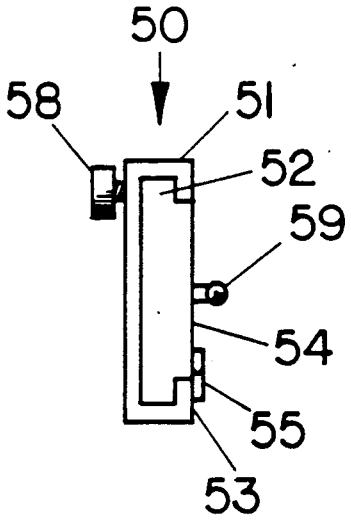
FIG. 12 is a side elevational view of another clip according to the invention, having an elastic extendable sealing means.

Referring now to FIGS. 12 and 13, shown is another inventive embodiment of an extendable clip member 50. The member 50 includes an outer elongate member 51 and an inner elongate member 52 in retained slidable relation thereto. The innermost surfaces of the elongate members 53 and 54 are in equiplanar relationship (i.e. lie in the same plane). The clip member also includes an elastic extendable sealing means 55 attached at one end to the innermost surface 54 of the inner elongate member (as at 56) and at the other end to the innermost surface 53 of the outer elongate member 51 (as at 57). This extendable sealing means 55 is preferably at least somewhat compressible, and may be, for example, a rubber band or similar elastic item. The attachments can be made by bonding, tether, or any other suitable means. The clip member 50 also includes means for selectively maintaining the position of the elongate members 51 and 52 in relation to one another (e.g. forcedly retaining the clip member 50 at a given extended position). In the illustrated device, this is accomplished with a screw or similar device 58 threaded through an aperture in the outer elongate member 51. The screw 58 can be tightened against the inner elongate member 52 thus holding it in place. The screw 58 or other retaining means is needed in the illustrated clip member 50 because when in its extended position, the elastic sealing means 55 will be exerting a force on the two members 51 and 52 tending to bring them back into their retracted position. The screw 58 could, of course, be replaced by a releasable ratchet or other similar means for retaining the extended relation of the elongate members 51 and 52. The clip member 50 can also include snapping means, such as 59, for cooperating to give a snap fit with another, optionally similar, extendable clip member which is pivotally or hingedly connected thereto to provide an overlapping relationship and thus effective clip for closing a bag. The other clip member may also include serrations as in other of the illustrated devices herein, and, in fact, the clip member 50 could be incorporated into devices similar to those described herein. It will thus be appreciated that the extendable elastic sealing means 55 as described in connection with the clip member 50 provide important and simplifying advantages in an extendable clip device.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A clip for closing a flexible plastic or paper bag having a first end which is open, and for removing excess bag portions therefrom, comprising:

first and second elongate members for at least substantially spanning the width of the bag on opposite sides thereof, said first and second elongate members being positionable at any one of a plurality of positions along the length of the bag;

means for directing areas of said elongate members together to close the bag, said closed bag having excess bag portions occurring toward the first end from said elongate members; and serrations provided along at least one of said elongate members for severing the excess bag portions from the bag, said serrations being positioned apart from said held together areas of said elongate members.

2. The clip of claim 1, wherein said serrations are integrally formed on at least one of said elongate members.

3. The clip of claim 2, wherein said elongate members are pivotally connected at at least one end.

4. The clip of claim 3, and also including third and fourth elongate members in slidable relation to said first and second elongate members, whereby said clip is extendable.

5. The clip of claim 3, wherein said elongate members are pivotally connected at each end such that they pivot about a longitudinal axis.

6. The clip of claim 5, and also comprising spring means for biasing said areas of said elongate members together to close the bag.

7. The clip of claim 6, wherein said elongate members are pivotally connected so that they can be rotated and thereby spaced at least one inch apart from each other.

8. The clip of claim 7, wherein said elongate members are pivotally connected so that they can be rotated and thereby spaced at least about two inches apart from each other.

9. The clip of claim 8, and also comprising third and fourth elongate members in slidable relation with said first and second elongate members, whereby said clip is extendable.

10. The clip of claim 8, wherein said elongate members are at least about 10 inches in length.

11. A bag cutting and closing clip, comprising:

first and second elongate members and means for directing the elongate members toward one another to close the bag, said first and second elongate members being positionable at any one of a plurality of positions along the length of the bag; and cutting means provided and effectively positioned on the clip for severing excess bag portions on one side of the clip from necessary bag portions on another side of the clip while the bag remains effectively closed between the elongate members.

12. The clip of claim 11, wherein said cutting means are serrations.

13. The clip of claim 11, wherein said elongate members are formed of rigid plastic.

14. The clip of claim 11, wherein said serrations are provided along an edge of one of said elongate members.

15. The clip of claim 13, wherein said elongate members are pivotally connected at at least one end.

16. The clip of claim 15, and also including third and fourth elongate members in slidable relation with said first and second elongate members, whereby said clip is extendable.

17. The clip of claim 15, wherein said elongate members are pivotally connected at each end whereby they pivot about a longitudinal axis.

18. The clip of claim 17, wherein said elongate members are pivotally connected such that they can be rotated and thereby spaced at least about two inches apart.

19. The clip of claim 18, and also comprising third and fourth elongate members in slidable relation to said first and second elongate members, whereby said clip is extendable.

20. A method for closing an open flexible bag and removing excess bag portions therefrom, comprising the steps of:

closing the bag at any one of a plurality of positions along its length between two elongate members provided on a clip also having cutting means effectively positioned for severing an excess portion on one side of the clip from a necessary bag portion on another side of the clip; and grasping and pulling the excess bag portion along the cutting means whereby it is severed from the necessary bag portion.

* * * * *